US008356508B2

(12) United States Patent
Davies

(10) Patent No.: US 8,356,508 B2
(45) Date of Patent: Jan. 22, 2013

(54) DETECTOR SYSTEM FOR FIXING TO A CAN BODYMAKER AND METHOD TO DYNAMICALLY MEASURING RAM ALIGNMENT IN A CAN BODYMAKER

(75) Inventor: Mark Davies, Childrey Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 804 days.

(21) Appl. No.: 12/517,708

(22) PCT Filed: Nov. 27, 2007

(86) PCT No.: PCT/EP2007/062886

§ 371 (c)(1),
(2), (4) Date: Jun. 4, 2009

(87) PCT Pub. No.: WO2008/068169

PCT Pub. Date: Jun. 12, 2008

(65) Prior Publication Data

US 2010/0082269 A1 Apr. 1, 2010

(30) Foreign Application Priority Data

Dec. 6, 2006 (GB) ..... 0624337.2

(51) Int. Cl.
*B21D 11/10* (2006.01)

(52) U.S. Cl. ..... 72/379.4; 72/16.3; 72/18.1; 72/715; 413/69

(58) Field of Classification Search ..... 72/15.3, 72/16.2, 16.3, 17.3, 18.1, 347, 348, 349, 72/361, 379.4, 715; 33/522; 209/597; 413/69
See application file for complete search history.

(56) References Cited

U.S. PATENT DOCUMENTS

| | | | | |
|---|---|---|---|---|
| 3,908,572 | A | | 9/1975 | Johnson et al. |
| 4,091,757 | A | | 5/1978 | Urban |
| 4,112,579 | A | * | 9/1978 | Kaye ..... 33/548 |
| 4,205,617 | A | | 6/1980 | Chmielowiec |
| 4,402,139 | A | * | 9/1983 | Noyes ..... 33/522 |
| 4,600,347 | A | | 7/1986 | Segredo et al. |
| 4,606,205 | A | | 8/1986 | Segredo et al. |
| 4,779,442 | A | * | 10/1988 | Welsh ..... 72/347 |
| 4,936,126 | A | * | 6/1990 | Sato ..... 72/20.1 |
| 5,027,580 | A | | 7/1991 | Hymes et al. |
| 5,142,769 | A | | 9/1992 | Gold et al. |
| 5,154,075 | A | | 10/1992 | Hahn et al. |

(Continued)

FOREIGN PATENT DOCUMENTS

| | | |
|---|---|---|
| GB | 2310043 | 8/1997 |

(Continued)

*Primary Examiner* — Edward Tolan
(74) *Attorney, Agent, or Firm* — Woodcock Washburn LLP

(57) ABSTRACT

A real time detector system for monitoring ram alignment in a can bodymaker measures ram (10) position immediately before and during impact with the dome forming station (1). Displacement measurements of the ram enable the user to adjust dome (1) position or otherwise correct ram (10) alignment and avoid multiple can failures.

9 Claims, 5 Drawing Sheets

U.S. PATENT DOCUMENTS

| | | | | |
|---|---|---|---|---|
| 5,212,977 | A | 5/1993 | Stuart | |
| 5,345,309 | A * | 9/1994 | Wertz et al. | 356/612 |
| 5,357,779 | A | 10/1994 | Hahn et al. | |
| 5,560,238 | A | 10/1996 | Allebach et al. | |
| 5,860,782 | A | 1/1999 | Campbell | |
| 6,105,341 | A | 8/2000 | Campbell | |
| 6,575,683 | B2 | 6/2003 | Buisson | |
| 6,623,230 | B1 | 9/2003 | Bagheri et al. | |
| 7,073,365 | B2 * | 7/2006 | Geho et al. | 72/352 |

FOREIGN PATENT DOCUMENTS

| | | |
|---|---|---|
| WO | WO 98/07534 | 2/1998 |
| WO | WO 2008/068169 | 6/2008 |

* cited by examiner

DETECTOR SYSTEM FOR FIXING TO A CAN BODYMAKER AND METHOD TO DYNAMICALLY MEASURING RAM ALIGNMENT IN A CAN BODYMAKER

CROSS-REFERENCE TO RELATED APPLICATIONS

This application is the National Stage of International Application No. PCT/EP2007/062886, filed Nov. 27, 2007, which claims the benefit of GB Application No. 0624337.2, filed Dec. 6, 2006, the disclosures of which are incorporated herein by reference in their entirety.

TECHNICAL FIELD

This invention relates to the alignment of a ram in a can bodymaker. In particular it relates to the alignment of the ram as it contacts a station for forming a dome in the base of a so-called "two-piece" can such as are in common use for the packaging of beverages.

BACKGROUND ART

In the manufacture of two piece cans, a punch on a bodymaker ram is used to push a drawn metal cup through wall ironing dies in order to iron the side wall and make a taller can. After passing through dies, the punch carries the drawn and wall ironed can into contact with a doming station.

Although the ram is supported in bearings, alignment of the ram will vary due to friction and wear. In addition, vibration of a high speed reciprocating ram means that the can still does not always contact the doming station in a fully concentric and aligned position.

Undesirable vibration of the ram will arise not only due to the variable 'droop' of the cantilever supported ram as it moves towards and back from its fully extended position, but also due to the impact of the can at the dome forming station.

Misalignment of the ram/punch when it carries a can into contact with the doming station will ultimately lead to split domes, particularly in aluminium cans. When the ram is only slightly misaligned, an arcuate split (referred to hereinafter as a 'smile') in the base of the can could arise which subsequently may result in burst cans at the fillers or customer. Base faults like smiles are not easily detectable by the naked eye during manufacture.

This invention seeks to provide an apparatus for detecting base defects such as split domes during manufacture and for measuring ram alignment dynamically.

DISCLOSURE OF INVENTION

According to the present invention, there is provided a detector system for fixing to a can bodymaker, the detector comprising: at least two sensors for measuring the amplitude of ram displacement both directly adjacent a doming station and during contact with the dome station; and means for converting the amplitude data into real time alignment measurements, whereby dynamic tracking and likelihood of fault development in can dome profile is assessed.

Unlike previous alignment measuring systems, the system of the invention is not only dynamic but also monitors ram alignment at the fully extended ram position where the most extreme misalignment is likely to occur due to the cantilever nature of ram support and the vibration associated with high speed bodymakers and impact of the punch in the dome station.

The detector system may use sensors which are positioned at 90° to each other. As a result of this positioning, the sensors provide an X-axis and Y-axis displacement measurement.

In the detector system, there may be an array of sensors around the fully extended position of the ram, adjacent the dome forming station. In this alternative detector system, arrangement of the sensors can be regularly (or irregularly) spaced, and provide not only 0° and 90° but also other angular displacement measurements, such as 180° and 270°. The limiting factor of routing cables may be overcome if, for example, radio or other remote signalling sensors are used.

Ideally, the detector system further comprises means for analysing ram displacement data and determining the likelihood of 'smiles' or split domes. Typically analysis is achieved by software which provides the user with likelihood of 'smiles' or splits in real time, in contrast with known manual/visual can monitoring. Slight misalignment which could result in 'smile' production is not reliably visible by the naked eye, especially if the person carrying out the assessment is tired.

The detector system may further comprise means for adjusting lateral dome station position to centralise the impact target of the ram in the dome station. This adjustment was previously done as a result of any visible misalignment but without quantifiable data was at best a rough correction to the dome station position. Even where the means for adjusting the dome position with the present invention is manual, it can be carried out based on real data as described below. Ideally, however, the correction can be achieved by mechanical means such as by adjustable bolt position.

According to a further aspect of the present invention, there is provided a method of dynamically measuring ram alignment in a can bodymaker, the method comprising: measuring ram displacement immediately adjacent a doming station; measuring ram displacement during contact between a can carried on the ram and the dome station; converting the amplitude data into real time alignment measurements; and assessing faults and likelihood of fault development in the can dome profile. The method may also include steps corresponding to the additional apparatus features described above.

BRIEF DESCRIPTION OF DRAWINGS

A preferred embodiment of the invention will now be described, by way of example only, with reference to the drawings, in which.

MODE(S) FOR CARRYING OUT THE INVENTION

Figure 1:
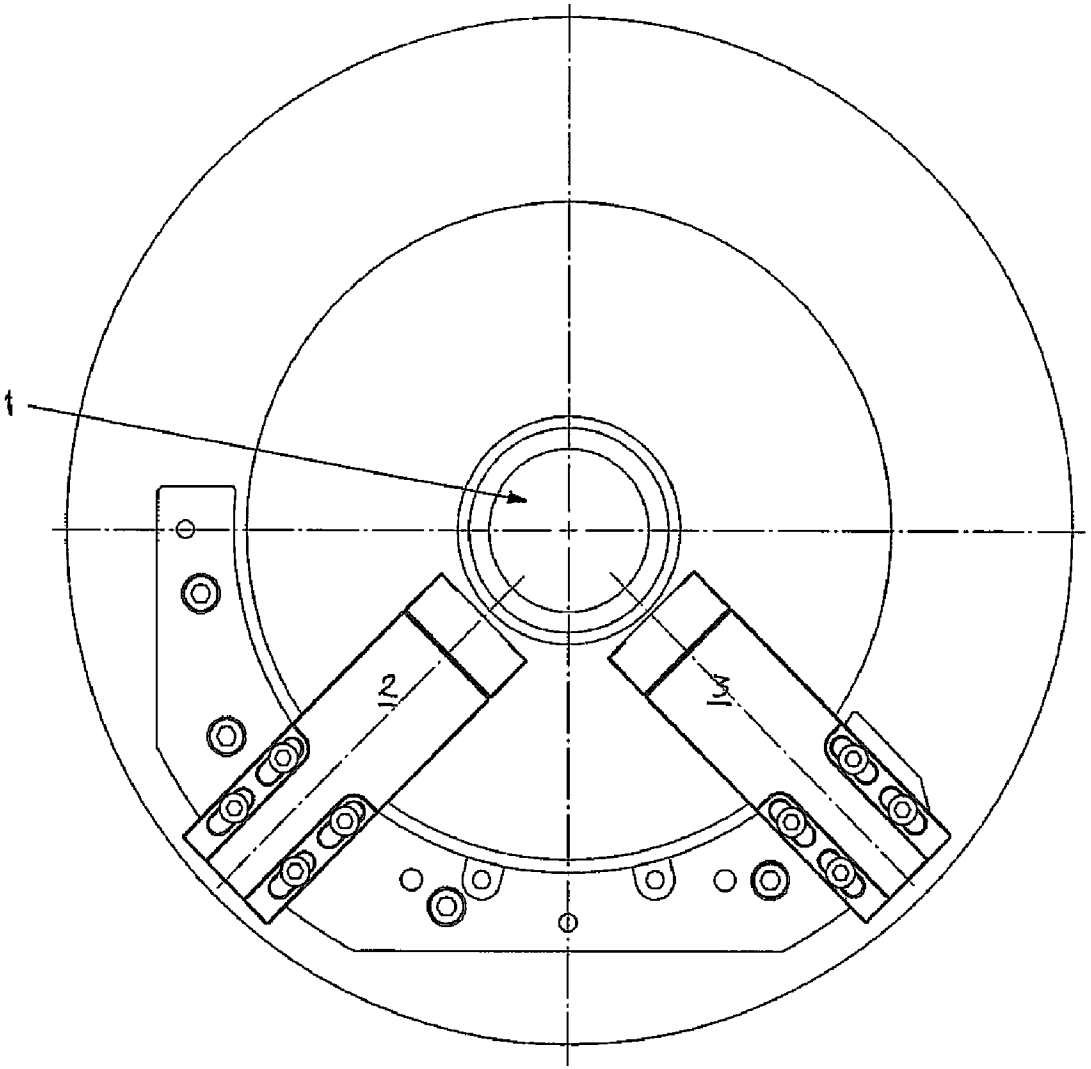
FIG. 1 is a schematic longitudinal view of a dome station and a detector system according to the invention.

FIG. 1 shows a can dome forming station 1 with sensor mounts 2 and 3. Sensors are conventional positional sensors which are mounted in the ends of mounts 2 and 3. These provide X and Y data so as to evaluate ram displacement at 90° to each other and immediately adjacent the bottom or dome forming position.

Figure 2:
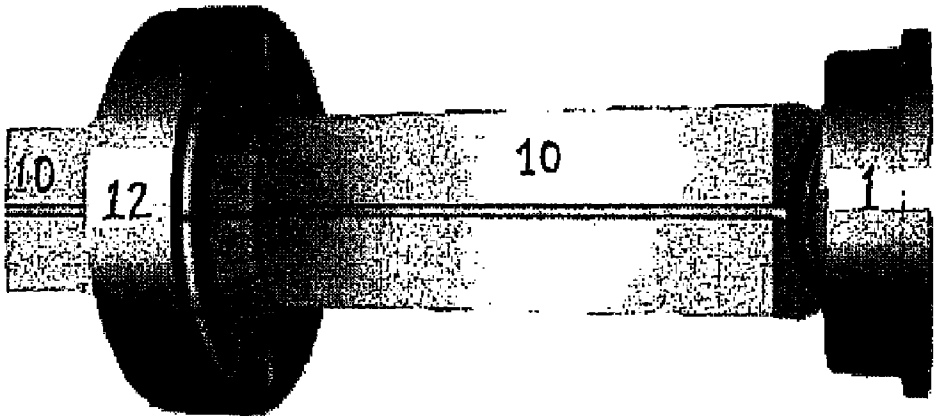
FIG. 2 is a schematic perspective view of a ram carrying a can in the dome forming station.

In FIG. 2, the ram 10 has passed through the wall ironing dies and a stripping die 12 to its fully extended position. The ram 10 is carrying a can 20 into the doming station 1. After the dome has been formed, the ram is retracted through the dies and the can is removed from the punch by stripper 12.

Figure 3:
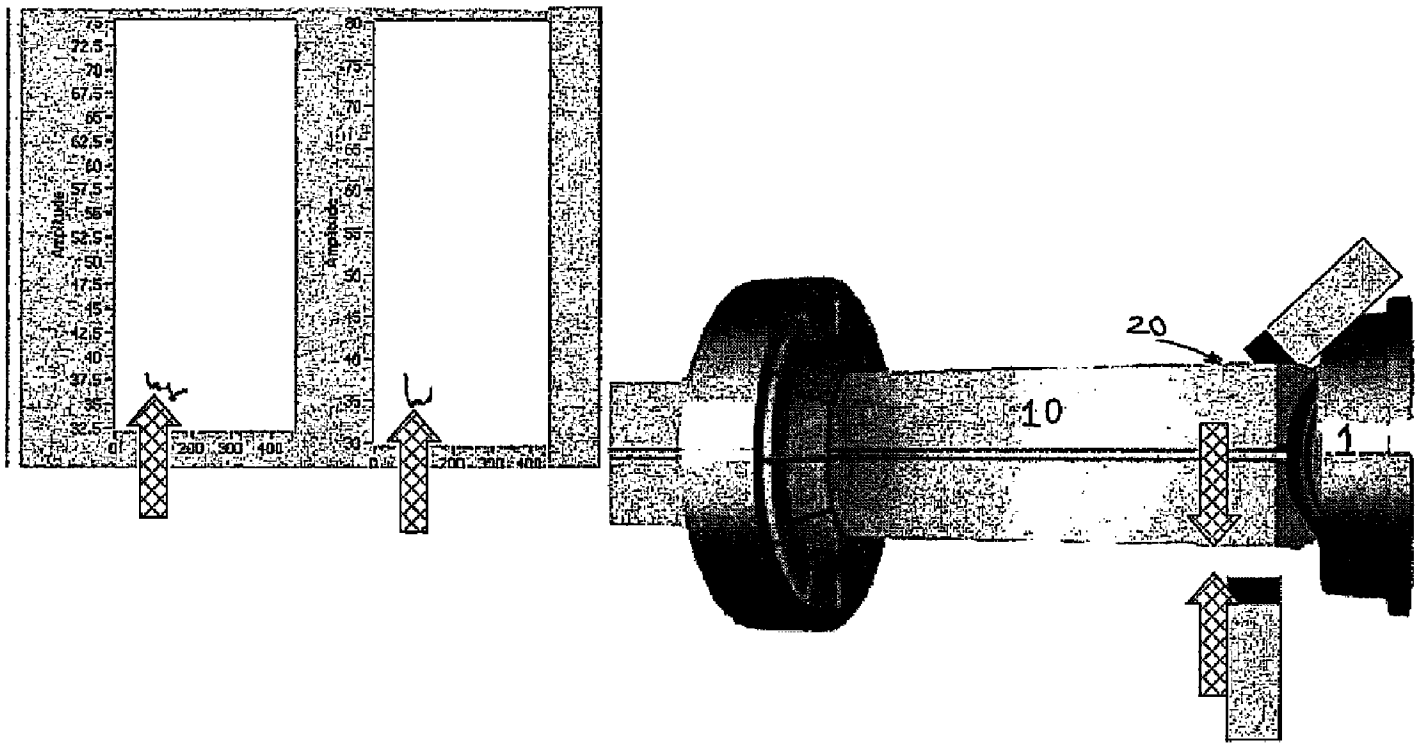
FIG. 3 is a view corresponding to that of FIG. 2, showing the sensors and ram displacement data.

The sensors 2 and 3 are shown schematically in FIG. 3 with the arrows indicating real time measurement taken for ram position. In this example, the sample graphs show ram displacement position in X-axis and Y-axis positions respectively before contact with the dome station.

Figure 4:
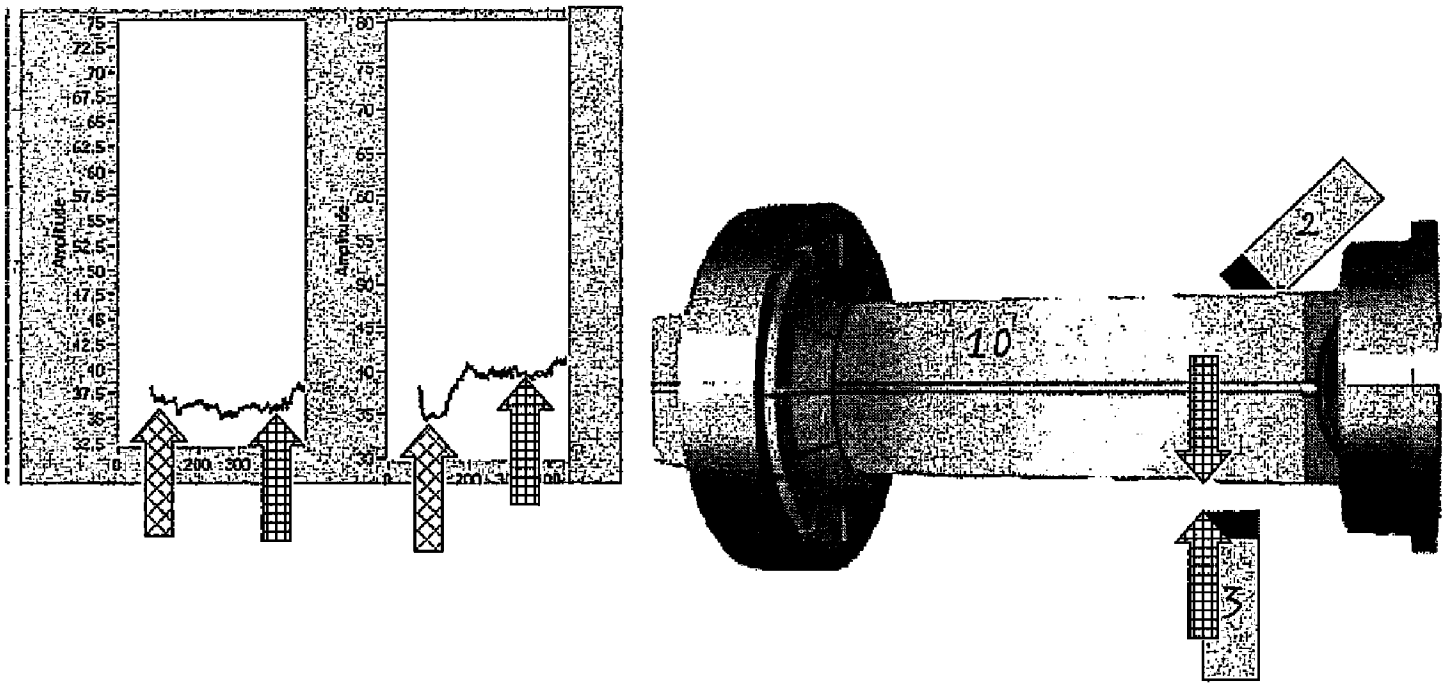
FIG. 4 is a view corresponding to that of FIG. 3, also showing ram displacement data.

In FIG. 4, a like view to that of FIG. 3 is shown but with the continuous measurements showing both before entering the dome station (left hand arrows) and while within the dome station forming a dome in the base of the can (right hand arrows). As can be clearly seen from the right hand graph, there has been misalignment in the Y-axis graph, as indicated by the step change and the arrows below the ram.

Figure 5:
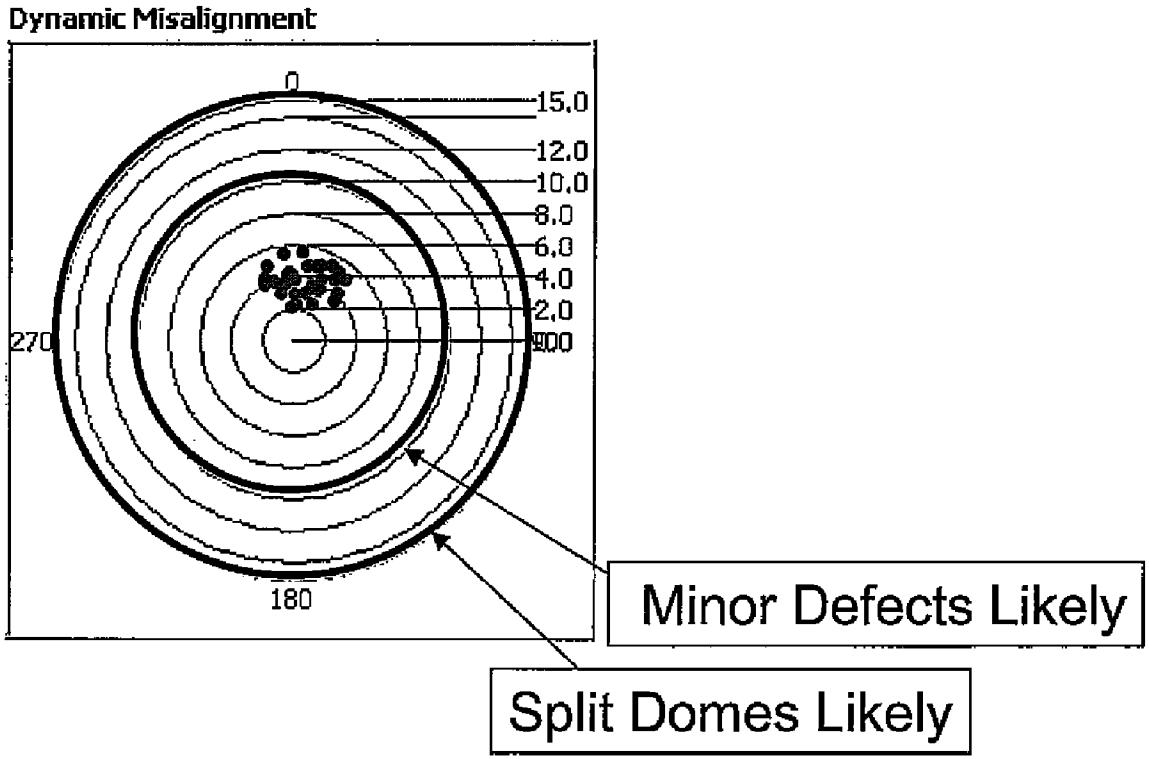
FIG. 5 is a schematic target showing multiple dome contact positions corresponding to ram misalignment.

The target picture of FIG. 5 gives a visual of how the base of the can contacts the doming station in a series of base forming operations. The cluster of can impact points indicates that there is a small misalignment in the 0° direction. The bold circles on the target show positions which would need immediate correction: where impact with the dome station occurs between the concentric circles, 'smiles' are likely to occur. These have been particularly difficult or impossible to detect by eye alone in the past. The catastrophic failure of split domes arises outside the outer circle. In the past, split dome failures have in fact been more readily detected by eye in the factory than were 'smiles' and so the occurrence of 'smiles' has been a major issue which affected cans in the market.

The detector system of the present invention is particularly cost-effective and can be developed to provide multiple axis data in real time.

The invention claimed is:

1. A detector system for a can bodymaker having a dome forming station, the detector system comprising at least two positional sensors mounted proximate the dome forming station;

a system that analyzes ram displacement data provided by the positional sensors during contact between a can carried on the ram and the dome forming station at a fully extended ram position, and that determines, in real time, the likelihood of fault development in a can dome profile.

2. A detector system according to claim 1, in which the positional sensors are positioned at 90° to each other and provide an X-axis and Y-axis displacement measurement.

3. A detector system according to claim 1, in which the at least two positional sensors comprise an array of sensors around the fully extended position of the ram, adjacent the dome forming station.

4. A detector system according to claim 1, further comprising a system for analysing ram displacement data and determining the likelihood of smiles or split domes.

5. A detector system according to claim 1, further comprising an adjusting mechanism capable of adjusting the lateral dome station position in response to ram displacement data to centralise the impact target of the ram in the dome station.

6. A method of dynamically measuring ram alignment in a can bodymaker, the method comprising:

receiving sensor output signals corresponding to ram displacement immediately adjacent a doming station during contact between a can carried on the ram and the dome station when the ram is in a fully extended ram position;

converting the amplitude data of the sensor output signal into real time ram alignment measurements; and assessing faults and likelihood of fault development in the can dome profile based on the alignment measurements.

7. The method according to claim 6 further comprising the step of enabling the adjustment of a lateral dome station position in response to the converting and assessing steps.

8. The detector system according to claim 1, further comprising mounts that connect the positional sensors to the dome forming station.

9. The detector system according to claim 8, in which the positional sensors are connected to ends of the mounts.

* * * * *